US007111577B1

(12) United States Patent
Bruno

(10) Patent No.: US 7,111,577 B1
(45) Date of Patent: Sep. 26, 2006

(54) ELECTROMAGNETIC WAVE PROPAGATION SCHEME

(75) Inventor: Anthony B. Bruno, East Lyme, CT (US)

(73) Assignee: The United States of America as represented by the Secretaryof the Navy, Washington, DC (US)

( * ) Notice: Subject to any disclaimer, the term of this patent is extended or adjusted under 35 U.S.C. 154(b) by 0 days.

(21) Appl. No.: 11/112,937

(22) Filed: Apr. 25, 2005

(51) Int. Cl.
*B63B 3/00* (2006.01)

(52) U.S. Cl. ..... 114/355; 73/775; 343/700 MS

(58) Field of Classification Search ..... 114/67 R, 114/355; 73/775; 343/700 MS, 787; 455/129
See application file for complete search history.

(56) References Cited

U.S. PATENT DOCUMENTS 4,933,680 A * 6/1990 Shapiro et al. ..... 343/700 MS
5,425,275 A * 6/1995 Lockshaw ..... 73/775
5,970,393 A * 10/1999 Khorrami et al. ..... 455/129
6,333,719 B1 * 12/2001 Varadan et al. ..... 343/787

* cited by examiner

*Primary Examiner*—Lars A. Olson
(74) *Attorney, Agent, or Firm*—James M. Kasischke; Jean-Paul A. Nasser; Michael P. Stanley

(57) ABSTRACT

An apparatus for effecting propagation of electromagnetic waves, comprising a hull outer surface, a dielectric material disposed over the hull outer surface, and an electrically conductive member embedded within the dielectric material. When a liquid medium contacts the dielectric material, the liquid medium, the hull outer surface, the dielectric material and the electrically conductive member cooperate to provide a waveguide through which electromagnetic waves can propagate wherein the boundaries of the waveguide are defined by the liquid medium and the hull outer surface. A sensor network can be provided within the dielectric material for receiving power and transmitting information.

13 Claims, 3 Drawing Sheets

ELECTROMAGNETIC WAVE PROPAGATION SCHEME

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention generally relates to an electromagnetic wave propagation scheme for use with sensors on undersea vehicles.

2. Description of the Related Art

Undersea vehicles, such as submarines, autonomous undersea vehicles, and autonomous undersea platforms, typical use sensors that are external to the pressure hull of the undersea vehicles. Such sensors are used to measure or detect pressure, acceleration, magnetic fields and acoustic energy. One such sensor is known as a MEMS (Micro Electronic Mechanical System) sensor. MEMS sensors are miniaturized sensors that are very adaptable to the undersea environment.

The sensors are typically arranged in a sensor grid, plane or array that can include hundreds of sensors. However, future missions and roles for undersea vehicles will certainly require a significant increase in the number of sensors. Furthermore, the requirements to reduce spectral signatures and increase detection capabilities in hostile and/or unforgiving littoral environments will require sensors that can be integrated into the structure of the undersea vehicles. Prior art techniques of extracting data and providing power to sensor grids or planes will not be able to accurately and efficiently extract data from and provide power to such future sensor configurations.

Therefore, what is needed is an apparatus that enables efficient, accurate quick interrogation, powering and reading of sensors used on undersea vehicles.

SUMMARY OF THE INVENTION

The present invention is directed to, in one aspect, an apparatus for effecting propagation of electromagnetic waves, comprising a hull outer surface, a dielectric material disposed over the hull outer surface, and an electrically conductive member embedded within the dielectric material. When a liquid medium contacts the dielectric material, the liquid medium, the hull outer surface, the dielectric material and the electrically conductive member define or form a waveguide through which electromagnetic waves can propagate wherein the boundaries of the waveguide are defined by the liquid medium and the hull outer surface. In one embodiment, the electrically conductive member comprises microstrip. In another embodiment, the electrically conductive member comprises stripline. In a further embodiment, the electrically conductive member comprises metal tape. In one embodiment, the apparatus further comprises a parasitic radiator embedded in the dielectric material and in electrical signal communication with the waveguide. In one embodiment, the dielectric material is formed by a Special Hull Treatment ("SHT") made from a commonly used material such as dura which is well known in the art.

BRIEF DESCRIPTION OF THE DRAWINGS

The figures are for illustration purposes only and are not drawn to scale. The invention itself, however, both as to organization and method of operation, may best be understood by reference to the detailed description which follows taken in conjunction with the accompanying drawings in which.

DESCRIPTION OF THE PREFERRED EMBODIMENT

In describing the preferred embodiments of the present invention, reference will be made herein to FIGS. 1–3 of the drawings in which like numerals refer to like features of the invention.

As used herein, the terms "electromagnetic wave" and "electromagnetic signals" are used interchangeably and are construed to have the same meaning. As used herein, the terms "hull" and "pressure hull" includes the hulls of ocean-going vessels, submarines, undersea or underwater vehicles, motor boats, and pleasure craft. As used herein, the term "liquid medium" includes oceans, lakes, and rivers. Therefore, although the ensuing description is in terms of the present invention being used in conjunction with an undersea vehicle, it is to be understood that the present invention can be used with almost any type of vessel configured for travel though a liquid medium.

Figure 1:
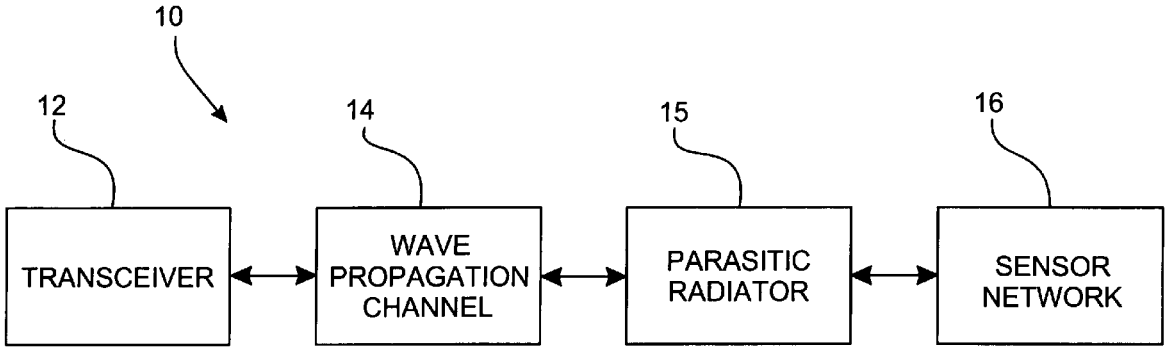
FIG. 1 is a block diagram of a communication system that incorporates the electromagnetic wave propagation channel of the present invention.

Referring to FIG. 1, there is shown communication system 10 that utilizes the electromagnetic wave propagation channel of the present invention. Communications system 10 generally comprises transceiver 12, electromagnetic wave propagation channel 14 of the present invention, parasitic radiator 15 and sensor network 16.

Transceiver 12 includes circuitry for generating and transmitting an encoded R.F. (radio frequency) or microwave signal. The encoded signal contains data that defines interrogation and/or read signals that are used to address individual sensors in sensor network 16. In a preferred embodiment, the encoded signal contains data that defines a code that corresponds to a particular sensor thereby allowing each sensor to be individually addressed. The encoded signal generated 11 by transceiver 12 also includes a signal component that powers the sensors in sensor network 16. Transceiver 12 also includes processing circuitry for processing sensor data detected by the sensors of sensor network 16.

In one embodiment, transceiver 12 includes circuitry for formatting sensor data signals into a format that is suitable for processing by a central processor (not shown) that is typically located within the undersea vehicle. In one embodiment, transceiver 12 includes circuitry for converting the formatted sensor data signals into optical signals. In such an embodiment, transceiver 12 includes a fiber optic penetrator (not shown) that functions as an interface between transceiver 12 and the central processor (not shown) within the undersea vehicle.

Figure 2:
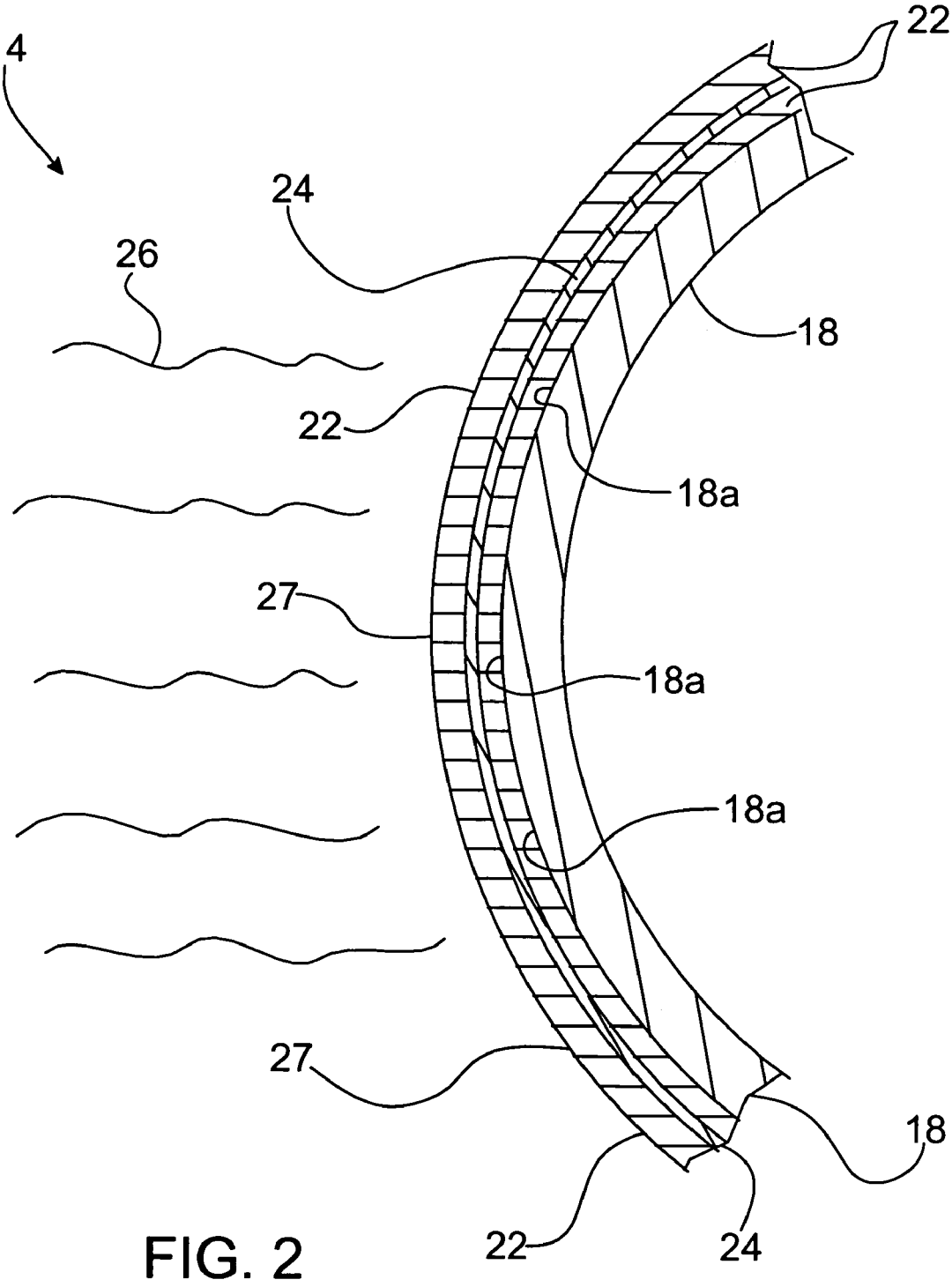
FIG. 2 is a partial cross-sectional view of the electromagnetic wave propagation channel of the present invention.
Figure 3:
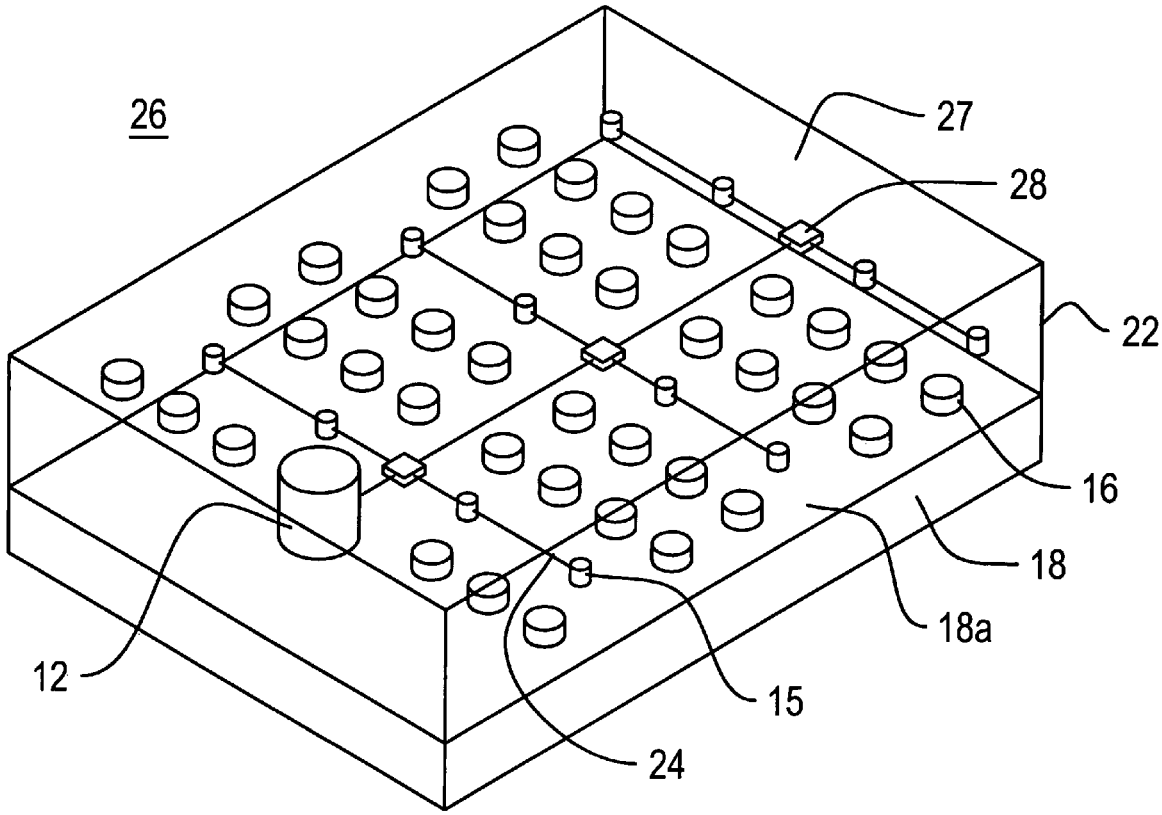
FIG. 3 is a perspective view, in diagrammatic form, of the electromagnetic wave propagation channel of the present invention embodied in the skin of an undersea vehicle.

Referring to FIGS. 1, 2 and 3, electromagnetic wave propagation channel 14 is in electrical signal communication with transceiver 12 and parasitic radiator 15. Wave propagation channel 14 utilizes pressure hull 18 of the undersea vehicle. Specifically, wave propagation channel 14 generally comprises outer surface 18*a* of pressure hull 18, a coating of dielectric material 22 that is disposed over outer surface 18*a*, and electrically conductive member 24 that is embedded within dielectric material 22. Dielectric material 22 has a predetermined dielectric constant and insulates electrically conductive member 24 from the liquid medium 26. Dielectric material 22 has an outer surface 27 that is exposed to liquid 11 medium 26. When hull 18 is disposed in liquid medium 26 and liquid medium 26 contacts outer surface 27 of dielectric material 22, a waveguide is formed by liquid medium 26, dielectric material 22, electrically conductive member 24, and hull outer surface 18*a*. The signals transmitted by transceiver 12 propagate through the waveguide. The boundaries of the aforementioned waveguide are hull outer surface 18*a* and liquid medium 26. The electromagnetic wave propagation through dielectric material 22 emulates the properties and characteristics of a Goubau wave which is well known in the art.

In one embodiment, the coating of dielectric material 22 has a thickness between one (1) and three (3) inches. However, dielectric material 22 can be configured to have a thickness less than one (1) inch or more than three (3) inches. In one embodiment, dielectric material 22 is formed by a process known in the art as Special Hull Treatment ("SHT"). In such a process, conductive member 24 is inserted into dielectric material 22 as the dielectric material is being poured or disposed over outer surface 18*a*. However, it is to be understood that other suitable processes and materials may be used to form the coating of dielectric material 22.

In one embodiment, conductive member 24 is configured as microstrip which is well known in the art. In another embodiment, conductive member 24 is configured as stripline which is well known in the art. In a further embodiment, conductive 11 member 24 is configured as metal tape.

In a preferred embodiment, the properties, dimensions and characteristics of dielectric material 22 and conductive member 24 are selected to effect efficient propagation of electromagnetic waves or signals at predetermined R.F. or microwave frequencies.

Preferably, the environmental conditions (i.e. pressure, temperature, etc.) to which wave propagation channel 14 will be exposed are considered when determining the dimensions and properties of conductive member 24 and when selecting the particular dielectric material so as to avoid significant impedance mismatches.

Parasitic radiator 15 is embedded in dielectric material 22 and is in electrical signal communication with wave propagation channel 14. Parasitic radiator 15 radiates the signals generated by transceiver 12 through dielectric material 22. Parasitic radiator 15 may be realized by any one of a number of well known suitable techniques or schemes.

Sensor network 16 comprises a plurality of sensors that are arranged in an array, grid, plane or any other suitable configuration. Sensor network 16 further comprises a transceiver that is configured to receive and decode the signals radiated from parasitic radiator 15. Each sensor may be configured as a MEMS sensor described in the foregoing description. However, other suitable sensors may be used as well. The transceiver of sensor network 16 generates and transmits an encoded R.F. or microwave signal that contains data that represents the sensor output data. The encoded signals transmitted by the transceiver of sensor network 16 are received by parasitic radiator 15. As a result, the encoded signals generated by the transceiver of sensor network 16 propagate through electromagnetic wave propagation channel 14 and are received by transceiver 12. Transceiver 12 decodes and processes the received signals and routes the processed signal to the central processor (not shown) within the undersea vehicle.

In one embodiment of the invention, each sensor has an inactive operational mode and an active operational mode. When the sensors are in the inactive operational mode, each sensor utilizes energy from the signals generated by transceiver 12 to power the sensor electronic circuitry and/or to charge micro-batteries that power the sensors. When the sensors are in the active operational mode, transceiver module 12 receives the encoded signals generated by the transceiver associated with the sensor network, decodes these signals, formats the decoded signals into a format that is suitable for processing by the central processor (not shown), and converts the formatted signals into optical signals. As described in the foregoing description, the optical signals are routed to the central processor (not shown) via the optical penetrator.

In one embodiment of the invention, conductive member 24 is configured as a conductive lattice having a plurality of conductive members 24 that are embedded within and extend throughout the dielectric material 22 so as to form a plurality of waveguides that are in electrical signal communication with each other. This configuration is useful when a plurality of sensor networks are utilized. In such a configuration, each waveguide corresponds to a particular sensor network and transceiver 12 generates and outputs encoded radio frequency signals or microwave signals that contain data that defines particular codes wherein a particular code corresponds to a particular sensor grid and a particular sensor within that sensor grid. This embodiment enables transceiver 12 to interrogate, read or power individual sensors within a particular sensor grid.

Useful techniques and schemes for interrogating, powering and reading sensor networks are described in commonly owned and co-pending U.S. patent application Ser. No. 10/652,084, filed 25 Aug. 2003, the disclosure of which is incorporated herein by reference. The techniques and schemes described in the aforementioned pending application may be used in conjunction with the present invention.

Although the foregoing description is in terms of the sensor network being embedded in dielectric material 22, it is to be understood that the sensor network can be located on the exterior of the dielectric material 22. In such an embodiment, the interface for coupling the encoded electromagnetic signals generated by transceiver 12 to the input of the transceiver of the sensor network is embedded within the dielectric material 22.

Electromagnetic wave propagation channel 14, parasitic radiator 15 and dielectric material 22 cooperate to substantially eliminate the need to use bundles of wires to communicate with the sensors. As a result, the present invention provides a substantial cost savings when a significantly large number of sensors are being used. Furthermore, electromagnetic wave propagation channel 14, parasitic radiator 15 and dielectric material 22 enable transceiver 12 to detect encoded signals from individual sensors regardless of the direction from which these signals emanate. Thus, the present invention allows the sensors to be efficiently, accurately and quickly interrogated and read thereby providing an active laboratory for hydrophone monitoring, platform self-quieting, cancellation of magnetic signatures, and other monitoring and processing activities.

The electromagnetic wave propagation channel of the present invention can be used in conjunction with commercially available integrated circuits dedicated to R.F. or microwave communication as well as commercially available DSP (digital signal processor) circuits.

While the present invention has been particularly described, in conjunction with a specific preferred embodiment, it is evident that many alternatives, modifications and variations will 11 be apparent to those skilled in the art in light of the foregoing description. It is therefore contemplated that the appended claims will embrace any such alternatives, modifications and variations as falling within the true scope and spirit of the present invention.

What is claimed is:

1. An apparatus for effecting propagation of electromagnetic waves, comprising:

a hull outer surface;

a dielectric material disposed over said hull outer surface; and an electrically conductive member embedded within said dielectric material;

whereby when a liquid medium contacts said dielectric material, the liquid medium, said hull outer surface, said dielectric material and said electrically conductive member define a waveguide through which electromagnetic waves can propagate wherein the boundaries of said waveguide are defined by the liquid medium and said hull outer surface.

2. The apparatus according to claim 1 wherein said electrically conductive member comprises microstrip.

3. The apparatus according to claim 1 wherein said electrically conductive member comprises stripline.

4. The apparatus according to claim 1 wherein said electrically conductive member comprises metal tape.

5. The apparatus according to claim 1 further comprising a parasitic radiator embedded in said dielectric material and in electrical signal communication with said waveguide.

6. A communications system, comprising:

a hull outer surface;

a dielectric material disposed over said hull outer surface;

an electrically conductive member embedded within said dielectric material;

whereby when a liquid medium contacts said dielectric material, the liquid medium, said hull outer surface, said dielectric material and said electrically conductive member define a waveguide through which electromagnetic waves can propagate wherein the boundaries of said waveguide are defined by the liquid medium and said hull outer surface;

a system processor configured to generate encoded electromagnetic signals that propagate through said waveguide;

a parasitic radiator embedded in said dielectric material for radiating the encoded electromagnetic signals throughout said dielectric material; and a sensor network having at least one sensor and circuitry for receiving and decoding the radiated encoded electromagnetic signals.

7. The communications system according to claim 6 wherein said electrically conductive member comprises microstrip.

8. The communications system according to claim 6 wherein said electrically conductive member comprises stripline.

9. The communications system according to claim 6 wherein said electrically conductive member comprises metal tape.

10. The communications system according to claim 6 wherein said system processor comprises a system transceiver.

11. The communications system according to claim 6 wherein said circuitry of the sensor network comprises a sensor transceiver.

12. The communications system according to claim 11 wherein said sensor transceiver generates and transmits encoded electromagnetic signals that represent the sensor data, said sensor transceiver being configured so that the encoded electromagnetic signals propagate through said dielectric material and are received by said parasitic radiator.

13. The communications system of claim 12 wherein each sensor of the sensor network has an inactive operational mode and an active operational mode, said inactive operational mode enabling said sensor to receive and store energy from said parasitic radiator, and said active operational mode enabling transmission of encoded electromagnetic signals by said sensor transceiver.

* * * * *